US011626072B2

(12) United States Patent
Hong et al.

(10) Patent No.: US 11,626,072 B2
(45) Date of Patent: Apr. 11, 2023

(54) DISPLAY DEVICE AND DRIVING METHOD THEREOF

(71) Applicant: LG Display Co., Ltd., Seoul (KR)

(72) Inventors: MooKyoung Hong, Gyeonggi-do (KR); Uitaek Jeong, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/463,955

(22) Filed: Sep. 1, 2021

(65) Prior Publication Data

US 2022/0199025 A1 Jun. 23, 2022

(30) Foreign Application Priority Data

Dec. 21, 2020 (KR) ..... 10-2020-0180258

(51) Int. Cl.
*G09G 3/3291* (2016.01)
*G09G 3/3258* (2016.01)
*G09G 3/3266* (2016.01)

(52) U.S. Cl.
CPC ..... *G09G 3/3258* (2013.01); *G09G 3/3266* (2013.01); *G09G 3/3291* (2013.01); *G09G 2310/08* (2013.01); *G09G 2320/0233* (2013.01)

(58) Field of Classification Search
CPC .. G09G 3/3233; G09G 3/3258; G09G 3/3266; G09G 3/3291; G09G 3/3618; G09G 3/3674; G09G 3/3685; G09G 2300/0819; G09G 2300/0842; G09G 2310/08; G09G 2310/061; G09G 2320/0233; G09G 2320/0285; G09G 2320/0295; G09G 2340/0435
See application file for complete search history.

(56) References Cited

U.S. PATENT DOCUMENTS

2013/0038621 A1* 2/2013 Choi ..... G09G 3/3406 345/589
2018/0061915 A1* 3/2018 Yu ..... H01L 27/3265
2018/0151109 A1* 5/2018 Shim ..... G09G 3/3233
2021/0366397 A1* 11/2021 Na ..... G09G 3/3233

* cited by examiner

*Primary Examiner* — Michael J Eurice
(74) *Attorney, Agent, or Firm* — Birch, Stewart, Kolasch & Birch, LLP

(57) ABSTRACT

Embodiments of the present disclosure relate to a display device and driving method thereof. A display device of the present disclosure includes a display panel including a plurality of gate lines, a plurality of data lines, and a plurality of subpixels. The display device further includes a gate driving circuit for supplying scan signals to the plurality of gate lines, a data driving circuit for supplying data voltage to the plurality of data lines, and a timing controller. The timing controller is for controlling the gate driving circuit and the data driving circuit, and controlling a luminance of the plurality of subpixels according to a driving frequency of image data by detecting a variable information which is changed according to the driving frequency of the image data supplied from a host system.

19 Claims, 12 Drawing Sheets

DISPLAY DEVICE AND DRIVING METHOD THEREOF

CROSS REFERENCE TO RELATED APPLICATION

This application claims priority to Korean Patent Application No. 10-2020-0180258, filed in the Republic of Korea on Dec. 21, 2020, the entire contents of which are hereby expressly incorporated by reference for all purposes as if fully set forth herein into the present application.

BACKGROUND

Field

Embodiments of the present disclosure relate to a display device and a driving method thereof.

Description of Related Art

With the development of the information society, there has been an increasing demand for a variety of types of image display devices. In this regard, a range of display devices, such as a liquid crystal display device, and an organic light emitting display device, have recently come into widespread use.

Among such display devices, the organic light emitting display devices have superior properties, such as rapid response speeds, high contrast ratios, high emissive efficiency, high luminance, and wide viewing angles, since self-emissive organic light emitting diodes are used.

Such a display device can include light emitting elements disposed in a plurality of subpixels aligned in a display panel, and can control the light emitting elements to emit light by controlling a voltage flowing through the light emitting elements, so as to display an image while controlling luminance of the subpixels.

In this case, the image data supplied to the display device can be a still image or a moving image variable at a constant speed. In the case of a moving image, it can be various types of image such as sports image, movie, and game image.

These various types of image data can have different image formats according to their types. For this reason, a variable refresh rate (VRR) mode for varying a driving frequency according to the type of image data can be used.

However, when subpixels are driven at various refresh rates using the variable refresh rate mode, a luminance deviation may occur due to different refresh rates, and thus image distortion and quality degradation such as flickers may be generated.

BRIEF SUMMARY OF THE EMBODIMENTS

Embodiments of the present disclosure can provide a display device and a driving method thereof capable of improving an image quality.

Embodiments of the present disclosure can provide a display device and a driving method thereof capable of decreasing quality degradation due to luminance deviation when a variable refresh rate mode is applied according to the type of image data.

In addition, embodiments of the present disclosure can provide a display device and a driving method thereof capable of decreasing quality degradation due to luminance deviation by detecting variable information included in a vertical synchronization signal in a variable refresh rate mode and correcting the luminance through the variable information.

In addition, embodiments of the present disclosure can provide a display device and a driving method thereof capable of decreasing quality degradation due to luminance deviation by detecting variable information included in a data enable signal in a variable refresh rate mode and correcting the luminance through the variable.

According to an aspect, embodiments can provide a display device comprising a display panel including a plurality of gate lines, a plurality of data lines, and a plurality of subpixels; a gate driving circuit configured to supply scan signals to the plurality of gate lines; a data driving circuit configured to supply data voltages to the plurality of data lines; and a timing controller configured to control the gate driving circuit and the data driving circuit, and control a luminance of the plurality of subpixels according to a driving frequency of image data by detecting a variable information which is changed according to the driving frequency of the image data supplied from a host system.

According to an aspect, the timing controller includes a default mode displaying the image data at one driving frequency, and a variable refresh rate mode displaying the image data at a plurality of frequencies.

According to an aspect, in the variable refresh rate mode, the image data with a predetermined luminance is supplied to the display panel for a predetermined period.

According to an aspect, in the variable refresh rate mode, one horizontal period is the same and a vertical blank period is variable with respect to the plurality of driving frequencies.

According to an aspect, the variable information is calculated through a time interval of a vertical blank period of a vertical synchronization signal supplied from the host system.

According to an aspect, the timing controller includes a level shifter configured to control an output level of the vertical synchronization signal and generate a control signal according to the vertical blank period of the vertical synchronization signal, and a control integrated circuit configured to control an operation of the level shifter.

According to an aspect, the level shifter includes a transistor to which the vertical synchronization signal is supplied to a gate node, a power voltage is connected to a drain node, and a charging capacitor is connected to a source node.

According to an aspect, the control signal is a signal for controlling a compensating circuit configured to generate a compensating value for the data voltage according to the characteristic value sensed from the plurality of subpixels.

According to an aspect, the control signal is a signal for controlling a reference voltage generating circuit configured to generate a display driving reference voltage supplied to the plurality of subpixels through a reference voltage line during a display driving period.

According to an aspect, the variable information is calculated by a number of transitions of a data enable signal supplied from the host system.

According to an aspect, the timing controller includes a level shifter configured to control an output level of the data enable signal, a control integrated circuit configured to control an operation of the level shifter, and a counter configured to generate a control signal by counting the number of transitions of the data enable signal supplied from the level shifter.

According to an aspect, the control signal is a signal for controlling a compensating circuit configured to generate a compensating value for the data voltage according to a characteristic value sensed from the plurality of subpixels.

According to an aspect, the control signal is a signal for controlling a reference voltage generating circuit configured to generate a display driving reference voltage supplied to the plurality of subpixels through a reference voltage line during a display driving period.

According to another aspect, embodiments can provide a driving method of a display device comprising a display panel including a plurality of gate lines, a plurality of data lines, and a plurality of subpixels, a gate driving circuit configured to supply scan signals to the plurality of gate lines, and a data driving circuit configured to supply data voltages to the plurality of data lines, where the method includes receiving image data and at least one timing signal corresponding to a driving frequency of the image data from a host system; detecting variable information which is changed according to the driving frequency of the image data from the at least one timing signal; and controlling a luminance of the plurality of subpixels according to the driving frequency of the image data based on the variable information.

In according to exemplary embodiments, it can provide a display device and a driving method thereof capable of improving an image quality.

In according to exemplary embodiments, it can provide a display device and a driving method thereof capable of decreasing quality degradation due to luminance deviation when a variable refresh rate mode is applied according to the type of image data.

In according to exemplary embodiments, it can provide a display device and a driving method thereof capable of decreasing quality degradation due to luminance deviation by detecting variable information included in a vertical synchronization signal in a variable refresh rate mode and correcting the luminance through the variable information.

In according to exemplary embodiments, it can provide a display device and a driving method thereof capable of decreasing quality degradation due to luminance deviation by detecting variable information included in a data enable signal in a variable refresh rate mode and correcting the luminance through the variable.

BRIEF DESCRIPTION OF DRAWINGS

The present disclosure will become more fully understood from the detailed description given hereinbelow and the accompanying drawings which are given by way of illustration only, and thus are not limitative of the present disclosure.

In the accompanying drawings.

DETAILED DESCRIPTION OF THE EMBODIMENTS

Figure 1:
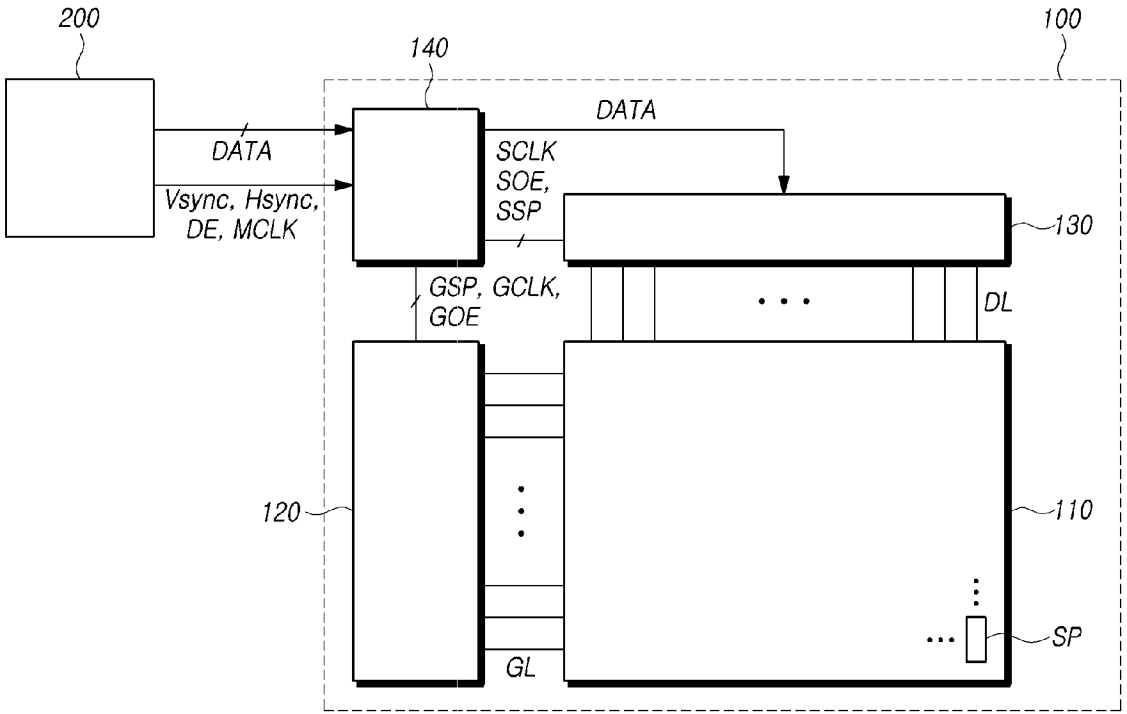
FIG. 1 illustrates a schematic diagram of a display device according to embodiments of the present disclosure.

In the following description of examples or embodiments of the present invention, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present invention, detailed descriptions of well-known functions and components incorporated herein will be omitted when it is determined that the description can make the subject matter in some embodiments of the present invention rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" can be used herein to describe elements of the present invention. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element can be included in at least one of two or more elements that "are connected or coupled to", "contact or overlap", etc. each other.

When time relative terms, such as "after", "subsequent to", "next", "before", and the like, are used to describe processes or operations of elements or configurations, or flows or steps in operating, processing, manufacturing methods, these terms can be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that can be caused by various factors (e.g., process factors, internal or external impact, noise, etc.) even when a relevant description is not specified. Further, the term "may" fully encompass all the meanings of the term "can".

FIG. 1 illustrates a schematic diagram of a display device according to embodiments of the present disclosure. All the components of each display device according to all embodiments of the present disclosure are operatively coupled and configured.

Referring to FIG. 1, a display device 100 according to the embodiments of the present disclosure can include a display panel 110 connected to a plurality of gate lines GL and a plurality of data lines DL in which a plurality of subpixels SP are arranged in rows and columns, a gate driving circuit 120 for supplying scan signals to the plurality of gate lines GL and a data driving circuit 130 for supplying data voltages to the plurality of data lines DL, and a timing controller 140 for controlling the gate driving circuit 120 and the data driving circuit 130.

The display panel 110 displays an image based on the scan signals supplied from the gate driving circuit 120 through the plurality of gate lines GL and the data voltages supplied from the data driving circuit 130 through the plurality of data lines DL.

In the case of a liquid crystal display, the display panel 110 includes a liquid crystal layer formed between two substrates, and TN (Twisted Nematic) mode, VA (Vertical Alignment) mode, IPS (In Plane Switching) mode, FFS (Fringe Field Switching) mode can be operated in any known mode. In the case of an organic light emitting display device, the display panel 110 can be implemented in a top emission method, a bottom emission method, or a dual emission method.

In the display panel 110, a plurality of pixels can be disposed in a matrix form. Each pixel can be composed of subpixels SP of different colors, for example, a white subpixel, a red subpixel, a green subpixel, and a blue subpixel. Each subpixel SP can be defined by the plurality of the data lines DL and the plurality of the gate lines GL.

For each subpixel SP, the subpixel SP can include a thin film transistor (TFT) arranged in a region where a data line DL and a gate line GL intersect, a light emitting element such as an organic light emitting diode which is emitted according to the data voltage, and a storage capacitor for maintaining the data voltage by being electrically connected to the light emitting element.

For example, when the display device 100 having a resolution of 2,160×3,840 includes a plurality of four subpixels SP of white W, red R, green G, and blue B, 3,840×4=15,360 data lines DL can be provided by 2,160 gate lines GL and 3,840 data lines DL respectively connected to 4 subpixels WRGB. Each of the plurality of subpixels SP can be disposed in areas in which the plurality of gate lines GL cross the plurality of data lines DL.

The gate driving circuit 120 is controlled by the timing controller 140, and controls the driving timing of the plurality of subpixels SP by sequentially supplying the scan signals to the plurality of gate lines GL disposed in the display panel 110.

In the display device 100 having a resolution of 2,160×3,840, an operation of sequentially supplying the scan signals to the 2,160 gate lines GL from the first gate line GL1 to the 2,160th gate line GL2160 can be referred to as 2,160-phase driving operation. Otherwise, an operation of sequentially supplying the scan signals to every four gate lines GL, as in a case in which the scan signals are supplied sequentially from first gate line GL1 to fourth gate lines GL4, and then are supplied sequentially from fifth gate line GL5 to eighth gate line GL8, can be referred to as 4-phase driving operation. As described above, an operation in which the scan signals are supplied sequentially to every N number of gate lines can be referred as N-phase driving operation.

The gate driving circuit 120 can include one or more gate driving integrated circuits (GDIC), which can be disposed on one side or both sides of the display panel 110 depending on the driving method. Alternatively, the gate driving circuit 120 can be implemented in a gate-in-panel (GIP) structure embedded in a bezel area of the display panel 110.

The data driving circuit 130 receives image data DATA from the timing controller 140, and converts the received image data DATA into an analog data voltage. Then, the data driving circuit 130 supplies the analog data voltage to each of the data lines DL at time which the scan signal is supplied through the gate line GL, so that each of the subpixels SP connected to the data lines DL emits light with a corresponding luminance in response to the analog data voltage.

Likewise, the data driving circuit 130 can include one or more source driving integrated circuits (SDIC). Each of the source driving integrated circuits SDIC can be connected to a bonding pad of the display panel 110 by a tape automated bonding (TAB) or a chip on glass (COG), or can be directly mounted on the display panel 110.

In some cases, each of the source driving integrated circuits (SDIC) can be integrated with the display panel 110. In addition, each of the source driving integrated circuits (SDIC) can be implemented with a chip on film (COF) structure. In this case, the source driving integrated circuit SDIC can be mounted on circuit film to be electrically connected to the data lines DL in the display panel 110 via the circuit film.

The timing controller 140 supplies various control signals to the gate driving circuit 120 and the data driving circuit 130, and controls the operations of the gate driving circuit 120 and the data driving circuit 130. For example, the timing controller 140 controls the gate driving circuit 120 to supply the scan signals in response to a time realized by respective frames, and on the other hand, transmits the digital image data DATA from an external source to the data driving circuit 130.

Here, the timing controller 140 receives not only the image data DATA, but also various timing signals, including a vertical synchronization signal Vsync, a horizontal synchronization signal Hsync, a data enable signal DE, and a main clock MCLK, from a host system 200.

The host system 200 can be any one of a Television (TV) system, a set-top box, a navigation system, a personal computer (PC), a home theater system, a mobile device, and a wearable device, but is not limited by this list and can be any other suitable system, device, module, or circuit.

Accordingly, the timing controller 140 generates control signals using the various timing signals received from the host system 200, and supplies the control signals to the gate driving circuit 120 and the data driving circuit 130.

For example, the timing controller 140 generates various gate control signals, including a gate start pulse GSP, a gate clock GCLK, and a gate output enable signal GOE, to control the gate driving circuit 120. Here, the gate start pulse GSP is used to control the start timing of one or more gate driving integrated circuits GDIC of the gate driving circuit 120. In addition, the gate clock GCLK is a clock signal commonly supplied to the one or more gate driving integrated circuits GDIC for controlling the shift timing of the scan signals. The gate output enable signal GOE designates timing information of the one or more gate driving integrated circuits GDIC.

In addition, the timing controller 140 generates various data control signals, including a source start pulse SSP, a source sampling clock SSC, and a source output enable signal SOE, to control the data driving circuit 130. Here, the source start pulse SSP is used to control the start timing for the data sampling of one or more source driving integrated circuits SDIC of the data driving circuit 130. The source sampling clock SSC is a clock signal for controlling a timing of data sampling in each of the source driving integrated circuits SDIC. The source output enable signal SOE controls the output timing of the data driving circuit 130.

The display device 100 can further include a power management integrated circuit for supplying or controlling various voltage or current to the display panel 110, the gate driving circuit 120, and the data driving circuit 130.

Meanwhile, the subpixel SP can be positioned at a point where the gate lines GL and the data lines DL intersect, and a light emitting element can be disposed in each subpixel SP. For example, the organic light emitting display device can include a light emitting element, such as an organic light emitting diode in each of the subpixels SP, and can display an image by controlling current flowing through the light emitting elements in response to the data voltage.

Such display devices 100 can be various types of devices such as a liquid crystal display, an organic light emitting display, and a plasma display panel.

Figure 2:
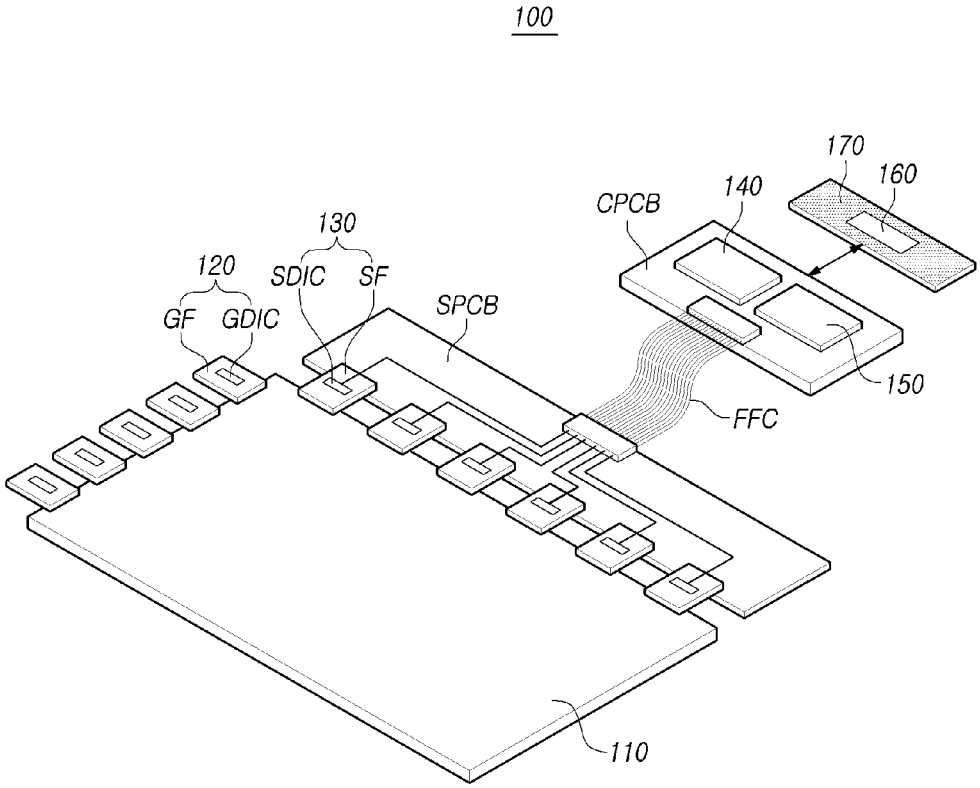
FIG. 2 illustrates a system diagram of the display device according to embodiments of the present disclosure.

FIG. 2 illustrates a system diagram of the display device according to embodiments of the present disclosure.

As an example, FIG. 2 illustrates that each of the source driving integrated circuits SDIC of the data driving circuit 130 and the gate driving circuit 120 in the display device 100 according to embodiments of the present disclosure are implemented with a COF type among various structures among various structures such as a TAB, a COG, and a COF.

AT least one of gate driving integrated circuits GDIC included in the gate driving circuit 120 can be mounted on each gate film GF, and one side of the gate film GF can be electrically connected to the display panel 110. Also, electrical lines for electrically connecting the gate driving integrated circuit GDIC and the display panel 110 can be disposed on the gate film GF.

Likewise, the data driving circuit 130 can include one or more source driving integrated circuits SDIC, which can be mounted on the source film SF, respectively. One portion of the source film SF can be electrically connected to the display panel 110. In addition, electrical lines can be disposed on the source films SF to electrically connect the source driving integrated circuits SDIC and the display panel 110.

The display device 100 can include at least one source printed circuit board SPCB in order to connect the plurality of source driving integrated circuits SDIC to other devices by electrical circuit, and a control printed circuit board CPCB in order to mount various control components and electric elements.

The other portion of the source film SF, on which the source driving integrated circuit SDIC is mounted, can be connected to the at least one source printed circuit board SPCB. For example, one portion of source film SF on which the source driving integrated circuit SDIC is mounted can be electrically connected to the display panel 110, and the other portion of the source film SF can be electrically connected to the source printed circuit board SPCB.

The timing controller 140 and a power management integrated circuit 150 can be mounted on the control printed circuit board CPCB. The timing controller 140 can control the operations of the data driving circuit 130 and the gate driving circuit 120. The power management integrated circuit 150 can supply a driving voltage and a driving current, or control a voltage and a current for the data driving circuit 130 and the gate driving circuit 120.

At least one source printed circuit board SPCB and the control printed circuit board CPCB can have circuitry connection by at least one connecting member. The connecting member can be, for example, a flexible printed circuit FPC, a flexible flat cable FFC, or the like. In this case, the connecting member for connecting the at least one source printed circuit board SPCB and the control printed circuit board CPCB can be variously changed according to the size and type of the display device 100. At least one source printed circuit board SPCB and the control printed circuit board CPCB can be integrated into a single printed circuit board.

The display device 100 can further include a set board 170 electrically connected to the control printed circuit board CPCB. The set board 170 can also be referred to as a power board. A main power management circuit M-PMC 160 managing overall power of the display device 100 can be located on the set board 170. The main power management circuit 160 can be coupled to the power management integrated circuit 150.

In the display device 100 having the above described configuration, a driving voltage is generated by the set board 170 to be supplied to the power management integrated circuit 150. The power management integrated circuit 150 supplies the driving voltage, which is required for a display driving operation or a sensing operation of the characteristic value, to the source printed circuit board SPCB through the flexible printed circuit FPC or the flexible flat cable FFC. The driving voltage supplied to the source printed circuit board SPCB, is transmitted to emit or sense a specific subpixel SP in the display panel 110 via the source driving integrated circuits SDIC.

Each of the subpixels SP arranged in the display panel 110 of the display device 100 can include an organic light emitting diode as a light emitting element and circuit elements such as a driving transistor to drive it.

The type and number of the circuit elements constituting each of the subpixels SP can be variously determined depending on the function, the design, or the like.

Figure 3:
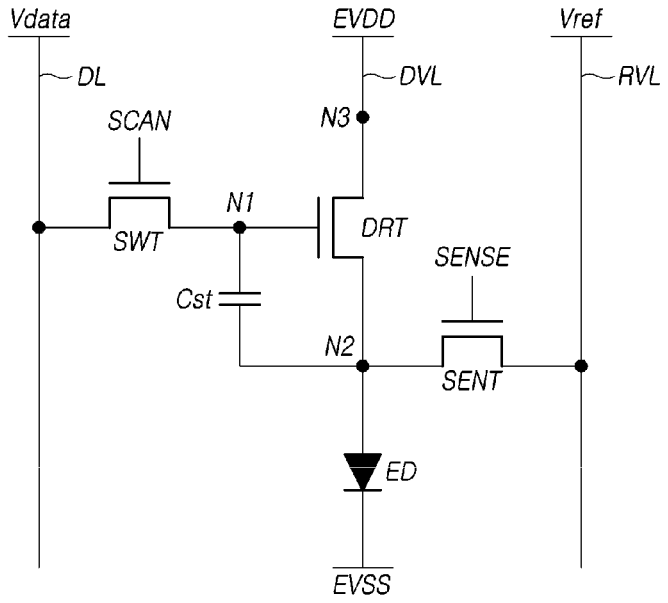
FIG. 3 illustrates a circuit diagram of a subpixel in the display device according to embodiments of the present disclosure.

FIG. 3 illustrates a circuit diagram of a subpixel in the display device according to embodiments of the present disclosure.

Referring to FIG. 3, each of the subpixels SP arranged in the display device 100 according to embodiments of the present disclosure can include one or more transistors, a capacitor, and an organic light emitting diode as a light emitting element ED.

For example, a subpixel SP can include a driving transistor DRT, a switching transistor SWT, a sensing transistor SENT, a storage capacitor Cst, and a light emitting element ED.

The driving transistor DRT can have a first node N1, a second node N2, and a third node N3. The first node N1 of the driving transistor DRT can be a gate node to be supplied a data voltage Vdata through a data line DL when the switching transistor SWT is turned on. The second node N2 of the driving transistor DRT can be electrically connected to an anode electrode of the light emitting element ED, and can be a drain node or a source node. The third node N3 of the driving transistor DRT can be electrically connected to a driving voltage line DVL to be supplied a driving voltage EVDD, and can be a source node or a drain node.

Here, the driving voltage EVDD for displaying an image can be supplied to the driving voltage line DVL in the display driving period. For example, the driving voltage EVDD for displaying the image can be about 27V.

The switching transistor SWT is electrically connected between the first node N1 of the driving transistor DRT and the data line DL, and operates in response to a scan signal SCAN supplied thereto through the gate line GL connected to the gate node. In addition, it controls the operation of the driving transistor DRT by transmitting the data voltage Vdata through the data line DL to the gate node of the driving transistor DRT when the switching transistor SWT is turned on.

The sensing transistor SENT is electrically connected between the second node N2 of the driving transistor DRT and a reference voltage line RVL, and operates in response to a sense signal SENSE supplied through the gate line GL connected to a gate node. When the sensing transistor SENT is turned on, a reference voltage Vref supplied from the reference voltage line RVL is transmitted to the second node N2 of the driving transistor DRT.

For example, the voltages of the first node N1 and the second node N2 of the driving transistor DRT can be controlled by controlling the switching transistor SWT and the sensing transistor SENT. Consequently, a current for emitting the light emitting element ED can be supplied.

Each gate node of the switching transistor SWT and the sensing transistor SENT can be connected to a single gate line GL or to different gate lines GL. Here, it illustrates an exemplary structure of which the switching transistor SWT and the sensing transistor SENT are connected to a different gate lines GL. In this case, the switching transistor SWT and the sensing transistor SENT are controlled independently by the scan signal SCAN and the sense signal SENSE transmitted from the different gate lines GL.

On the other hand, when the switching transistor SWT and the sensing transistor SENT are connected to single gate line GL, the switching transistor SWT and the sensing transistor SENT are controlled simultaneously by the scan signal SCAN or the sense signal SENSE transmitted from the single gate line GL, and thus the aperture ratio of the subpixels SP can be improved.

In addition, the transistors disposed in the subpixels SP can be not only n-type transistors, but can be p-type transistors. Herein, it illustrates an example structure of the n-type transistors, but other variations are possible.

The storage capacitor Cst is electrically connected between the first node N1 and the second node N2 of the driving transistor DRT, and serves to maintain the data voltage Vdata during a frame.

Such a storage capacitor Cst can be connected between the first node N1 and the third node N3 of the driving transistor DRT according to a type of the driving transistor DRT. The anode electrode of the light emitting element ED can be electrically connected to the second node N2 of the driving transistor DRT, and a base voltage EVSS can be supplied to a cathode electrode of the light emitting diode EL.

Here, the base voltage EVSS can be the ground voltage or a voltage higher or lower than the ground voltage. In addition, the base voltage EVSS can be varied depending on the driving condition. For example, the base voltage EVSS during the display driving period can be different from the base voltage EVSS during the sensing period.

The structure of the subpixel SP described as an example above is a 3T1C (3 Transistors 1 Capacitor) structure, which is only an example for explanation, and further includes one or more transistors, or in some cases, further includes one or more capacitors. Alternatively, each of the plurality of subpixels SP can have the same structure, or some of the plurality of subpixels SP can have different structures.

The display device 100 according to an embodiment of the present disclosure can use a method for measuring a current flowing by voltage charged in the storage capacitor Cst during a sensing period of the characteristic value for the driving transistor DRT in order to effectually sense the characteristic value of the driving transistor DRT like threshold voltage or mobility. Such a method can be referred to as a current sensing operation.

For example, the characteristic value or variation of the characteristic value of the driving transistor DRT in the subpixel SP can be determined by measuring the current flowing by voltage charged in the storage capacitor Cst during the sensing period of the characteristic value for the driving transistor DRT.

At this time, the reference voltage line RVL can be referred to as a sensing line since the reference voltage line RVL serves not only to supply the reference voltage Vref but also serves as a sensing line for sensing the characteristic value of the characteristic value for the driving transistor DRT in the subpixel SP.

Figure 4:
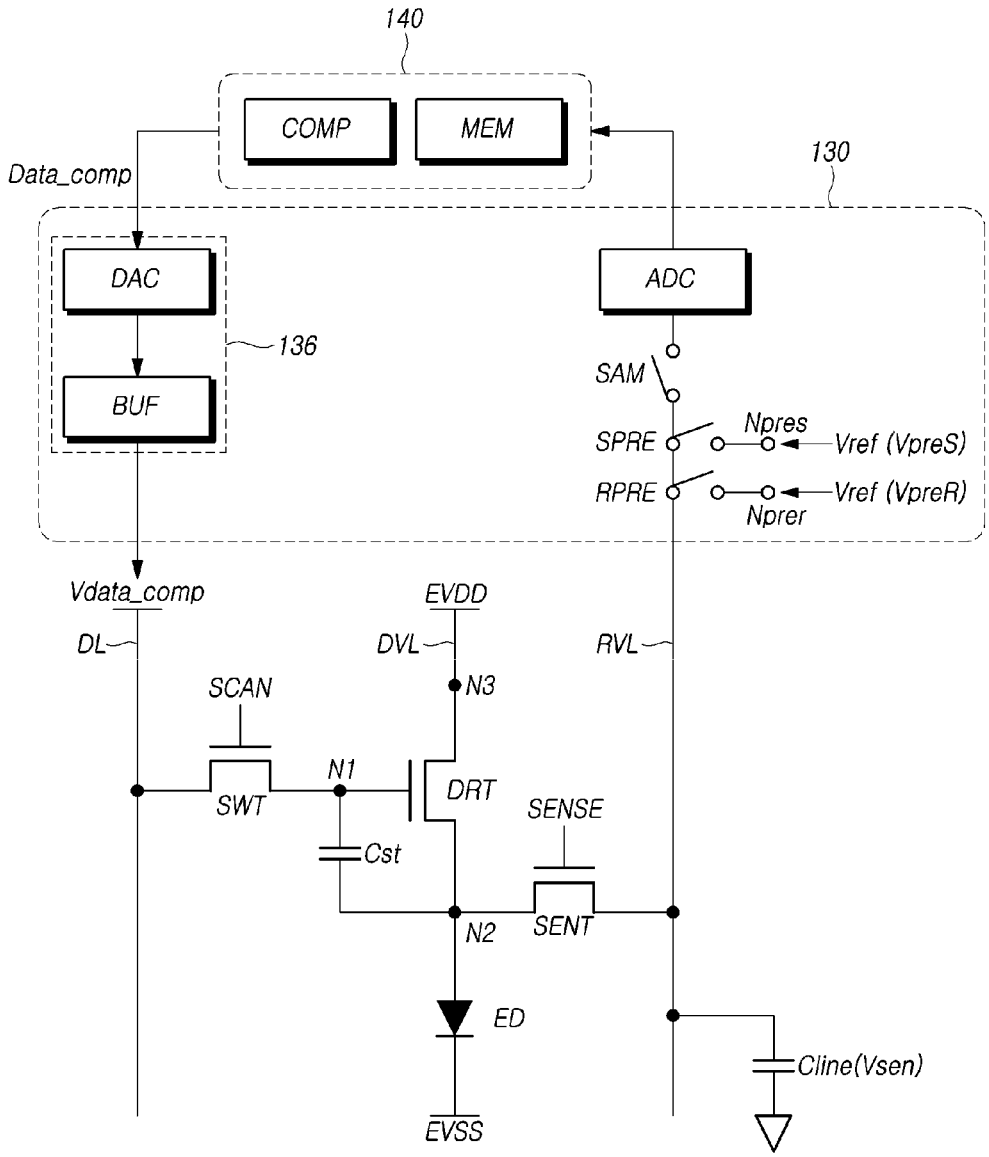
FIG. 4 illustrates an exemplary circuit structure for sensing a characteristic value of a driving transistor in a display device according to embodiments of the present disclosure.

FIG. 4 illustrates an exemplary circuit structure for sensing a characteristic value of a driving transistor in a display device according to embodiments of the present disclosure.

Referring to FIG. 4, the display device 100 according to embodiments of the present disclosure can include components for compensating for deviation in characteristic values of the driving transistor DRT.

For example, characteristic value or a difference in the characteristic value of a driving transistor DRT can be reflected to a voltage in a second node N2 of the driving transistor DRT (e.g., Vdata−Vth). The voltage in the second node N2 of the driving transistor DRT can be corresponded to a voltage in a reference voltage line RVL when a sensing transistor SENT is tuned on. Further, by the voltage in the second node N2 of the driving transistor DRT, a line capacitor Cline across the reference voltage line RVL can be charged, and the reference voltage line RVL can have a voltage corresponding to a voltage in the second node N2 of the driving transistor DRT by a sensing voltage Vsen charged in the line capacitor Cline.

The display device 100 can include an analog to digital converter ADC for measuring a voltage in the reference voltage line RVL corresponding to a voltage in the second node N2 of the driving transistor DRT and then converting the measured voltage into a digital value, and switches SAM, SPRE for sensing one or more characteristic values.

The switch circuits SAM, SPRE for controlling the sensing operation of the characteristic value can include a sensing reference switch SPRE for controlling a connection between the reference voltage line RVL and a supply node of the sensing reference voltage Npres to which a reference voltage Vref is supplied, and a sampling switch SAM for controlling a connection between the reference voltage line RVL and the analog to digital converter ADC. Here, the sensing reference switch SPRE is a switch for controlling the sensing operation of the characteristic value, and a reference voltage Vref supplied to the reference voltage line RVL by the sensing reference switch SPRE corresponds to a sensing reference voltage VpreS.

Further, the switch circuit for sensing characteristic values of the driving transistor DRT can include a display driving reference switch RPRE. The display driving reference switch RPRE controls a connection between the reference voltage line RVL and a supplying node of the display driving reference voltage Nprer to which the reference voltage Vref is supplied. The display driving reference switch RPRE is a switch for controlling the display driving operation, and the reference voltage Vref supplied to the reference voltage line RVL by the display driving reference switch RPRE corresponds to a display driving reference voltage VpreR.

The display driving reference switch RPRE and the sensing reference switch SPRE can be provided separately from each other, or integrated with each other and in turn, implemented in a single body. The display driving reference voltage VpreR and the sensing reference voltage VpreS can have an identical voltage value or different voltage values.

The timing controller 140 of the display device 100 can include a memory MEM storing data supplied from the analog to digital converter ADC or storing one or more reference voltages in advance, and a compensating circuit COMP for compensating a difference in one or more characteristic values by comparing the received data and reference voltages stored in the memory MEM. In this case, the compensating value calculated by the compensating circuit COMP can be stored in the memory MEM.

Compensating values for compensating for a characteristic value of the driving transistor DRT for each subpixel SP can be stored in the memory MEM in the form of a lookup table. The compensating circuit COMP transmits the sensing data received through the analog to digital converter ADC into the lookup table, and adds or multiplies the compensating value transmitted from the lookup table to the image data DATA received from the host system 200 to compensate a change in electrical characteristics of the driving transistor DRT. For example, a compensating value for compensating for the threshold voltage Vth of the driving transistor DRT can be added to the image data DATA, and a compensating value for compensating for mobility of the driving transistor DRT can be multiplied by the image data DATA.

The timing controller 140 can compensate image data DATA to be provided to the data driving circuit 130 using the compensating value calculated by the compensating circuit COMP, and then supply the compensated image data DATA comp to the data driving circuit 130. According to this configuration, the data driving circuit 130 can convert the compensated image data DATA comp into a compensated data voltage Vdata comp in the form of an analog signal through a digital to analog converter DAC, and transmit the compensated data voltage Vdata comp to a corresponding data line DL through an output buffer BUF. As a result, a deviation in one or more characteristic values (a deviation of threshold voltage or a deviation of mobility) for a driving transistor DRT in a corresponding subpixel SP can be compensated.

As described above, a sensing period for the characteristic value (the threshold voltage or the mobility) of the driving transistor DRT can be proceed after a power-on signal is generated and before the display driving operation is started. For example, when the power-on signal is supplied to the display device 100, the timing controller 140 loads parameters necessary for driving the display panel 110 and then performs a display driving operation. In this case, the parameters necessary for driving the display panel 110 can include information about the sensing process and compensation process for characteristic value previously performed by the display panel 110. The sensing process for the characteristic value (the threshold voltage or the mobility) of the driving transistor DRT can be performed during the parameter loading process. As described above, the sensing process for the characteristic value during the parameter loading process after the power-on signal is generated can be referred to as an on-sensing process.

Alternatively, the sensing process for the characteristic value of the driving transistor DRT can be performed after the power-off signal for the display device 100 is generated. For example, when the power-off signal is generated in the display device 100, the timing controller 140 can terminate the image display process in the display panel 110, and perform the sensing process for the characteristic value of the driving transistor DRT during a predetermined time. In this way, the sensing process for the characteristic value in a state in which a light emission is terminated by blocking the data voltage from the power-off signal can be referred to as an off-sensing process.

In addition, the sensing period for the characteristic value of the driving transistor DRT can be performed in real time while the display driving process is progressed. This sensing process can be referred to as a real-time RT sensing process. In the case of the real-time sensing process, the sensing process can be performed for one or more subpixels SP in one or more subpixel lines for each blank period during the display driving period.

For example, a blank period in which the data voltage is not supplied to the subpixel SP can exist within one frame or between the nth frame and the (n+1)th frame during the display driving period in which an image is displayed on the display panel 110. Accordingly, the sensing process of the mobility for one or more subpixels SP can be performed in the blank period.

As described above, when the sensing process is performed in the blank period, the subpixel SP line on which the sensing process is performed can be randomly selected. Accordingly, abnormal phenomenon that can appear in the display driving period can be diminished after the sensing process in the blank period is performed. In addition, after the sensing process is performed during the blank period, a recovery data voltage can be supplied to the subpixel SP on which the sensing process was performed during the display driving period. Accordingly, abnormal phenomenon in the subpixel SP line for which the sensing process is completed in the display driving period after the sensing process in the blank period can be further diminished.

Meanwhile, the data driving circuit 130 can include a data voltage output circuit 136 including a latch circuit, the digital to analog converter DAC, the output buffer BUF, and the like. In some instances, the data driving circuit 130 can further include an analog to digital converter ADC and several types of switches SAM, SPRE, RPRE. In another embodiment, the analog to digital converter ADC and the several types of switches SAM, SPRE, RPRE can be located outside of the data driving circuit 130.

Further, the compensating circuit COMP can be located outside of the timing controller 140 or included inside of the timing controller 140. The memory MEM can be located outside of the timing controller 140 or implemented in the form of a register inside of the timing controller 140.

The display device 100 of the present disclosure can have a default mode that operates at one fixed frequency and a variable refresh rate mode (VRR Mode) that operates a plurality of frequencies according to the type of image data DATA supplied from the host system 200.

Figure 5:
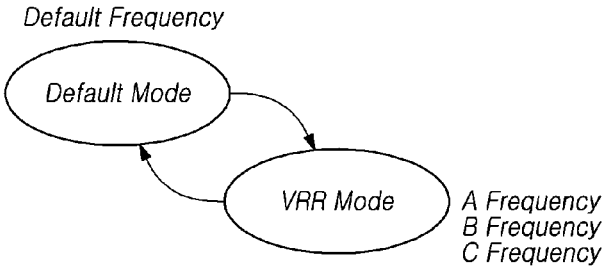
FIG. 5 illustrates an exemplary concept in which a default mode and a VRR mode are switched according to a type of image data in a display device according to embodiments of the present disclosure.

PIN FIG. 5 illustrates an exemplary concept in which a default mode and a VRR mode are switched according to a type of image data in a display device according to embodiments of the present disclosure.

Referring to FIG. 5, the display device 100 according to embodiments of the present disclosure can have a default mode for displaying general image data such as a TV image with one fixed frequency, and a variable refresh rate mode (VRR Mode) for displaying special image data such as a game image or movie with a plurality of frequencies according to a selected function. However, the image data operating in the default mode and the image data operating in the variable refresh rate mode can be variously changed, and the image data described herein corresponds to some examples.

In this case, the operation mode classified according to whether the frequency for displaying image data is variable can be expressed in various terms other than the default mode and the variable refresh rate mode.

For example, a TV image can operate in a default mode driven at a fixed frequency of 120 Hz, and a special image such as a game image or a movie can operate at a first frequency (e.g., A frequency) or at a second frequency (e.g., B frequency) or a third frequency (e.g., C frequency) according to a control.

In other words, the default mode and the variable refresh rate mode can be understood as the first mode and the second mode depending on whether the driving frequency for displaying the image data DATA on the display panel 110 is fixed or variable, respectively.

When the host system 200 transmits a TV image to the display device 100, it will operate in a default mode in which image data DATA is supplied through a fixed default frequency. When a special image such as a game image or a movie is supplied while the image data DATA is supplied at a fixed default frequency in the default mode, the host system 200 can be changed to the variable refresh rate mode and supply the image data DATA while changing the driving frequency among the first frequency (A frequency), the second frequency (B frequency), or the third frequency (C frequency) according to selected functions.

Conversely, when the TV image is supplied again in the process of the variable refresh rate mode, it can be changed to the default mode and the image data DATA can be supplied at a fixed default frequency.

As described above, the display device 100 of the present disclosure can have a default mode that operates at a fixed default frequency and a variable refresh rate mode that operates at a plurality of frequencies according to a type of image data DATA supplied from the host system 200.

Meanwhile, the display device 100 of the present disclosure can supply image data with a specific luminance to the display panel 110 for a certain period in order to distinguish a previous mode before the change and a present mode after the change in the process of changing from the default mode to the variable refresh rate mode or from the variable refresh rate mode to the default mode.

For example, when the default mode is changed to the variable refresh rate mode, image data with A luminance can be supplied to the display panel 110 for a predetermined period. Alternatively, when the variable refresh rate mode is changed to the default mode, image data with B luminance can be supplied to the display panel 110 for a predetermined period.

Accordingly, whether to change between the default mode and the variable refresh rate mode can be determined by detecting a luminance of the data voltage Vdata supplied from the data driving circuit 130 to the display panel 110 or detecting a luminance through a luminance detecting camera.

Figure 6:
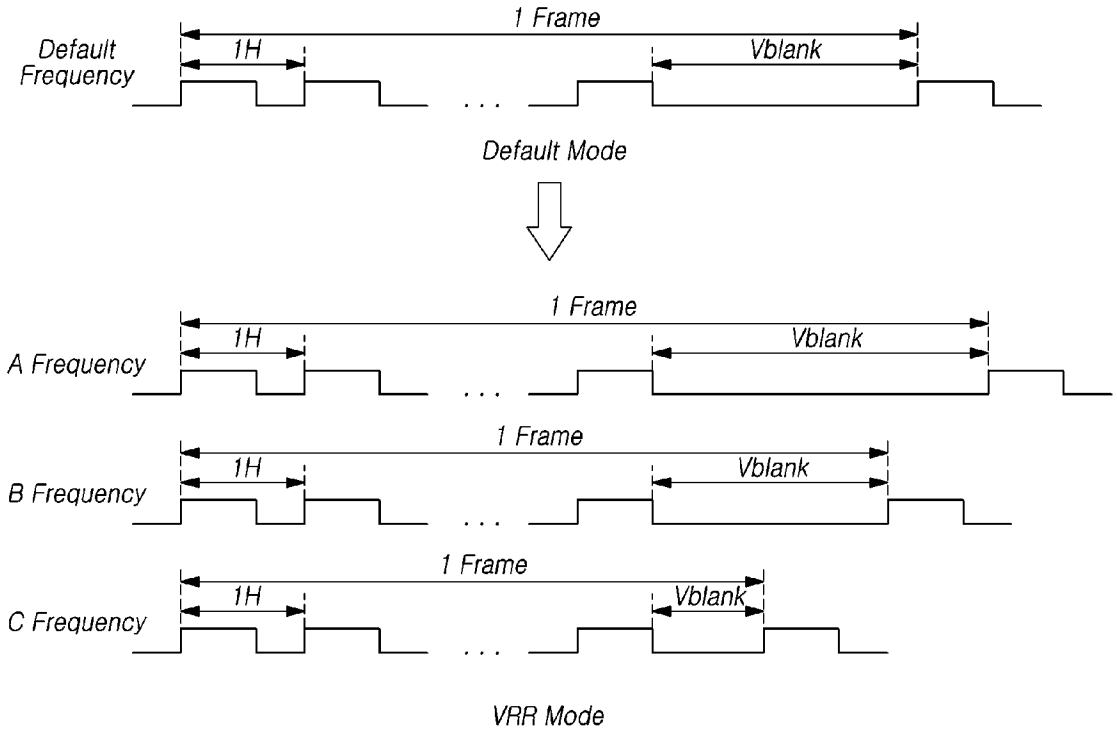
FIG. 6 illustrates an example of signal waveforms in a default mode and a variable refresh rate mode in a display device according to embodiments of the present disclosure.

FIG. 6 illustrates an example of signal waveforms in a default mode and a variable refresh rate mode in a display device according to embodiments of the present disclosure.

Here, it illustrates the data enable signal DE supplied from the host system 200 to the display device 100 as an example.

Referring to FIG. 6, the data enable signal DE in the default mode in the display device 100 according to embodiments of the present disclosure can include a high level period to which image data DATA is supplied and one horizontal period (1H) with a horizontal blank period. The data enable signal DE can include one horizontal period 1H to correspond to the number of gate lines GL constituting the display panel 110 and include one frame with a vertical blank period Vblank.

For example, when the default frequency in the default mode is 120 Hz, the image data DATA of one frame can be repeatedly supplied 120 times for 1 second to configure the image screen.

Meanwhile, when entering the variable refresh rate mode according to the type of image data DATA supplied from the host system 200, the display device 100 can have a plurality of frequencies, for example, a first frequency (A frequency), the second frequency (B frequency) and the third frequency (C frequency) within the range of the driving frequency.

At this time, even if the driving frequency is changed in the variable refresh rate mode, one horizontal period 1H can be fixed to the same value for stable image display, and the length of one frame can be adjusted by varying the vertical blank period Vblank.

As described above, when the driving frequency is changed in the variable refresh rate mode, the period during which the image data DATA is supplied by the data enable signal DE can be constant. However, luminance deviation due to a change of frequency may occur because the length of the vertical blank period Vblank is changed.

Image distortion or flicker may occur due to such a luminance deviation. Accordingly, image quality can be improved by detecting variable information included in the vertical synchronization signal Vsync that is changed according to an operation mode or a driving frequency and compensating for an expected luminance deviation. In this case, the variable information included in the vertical synchronization signal Vsync can be information on the vertical blank period Vblank.

Figure 7:
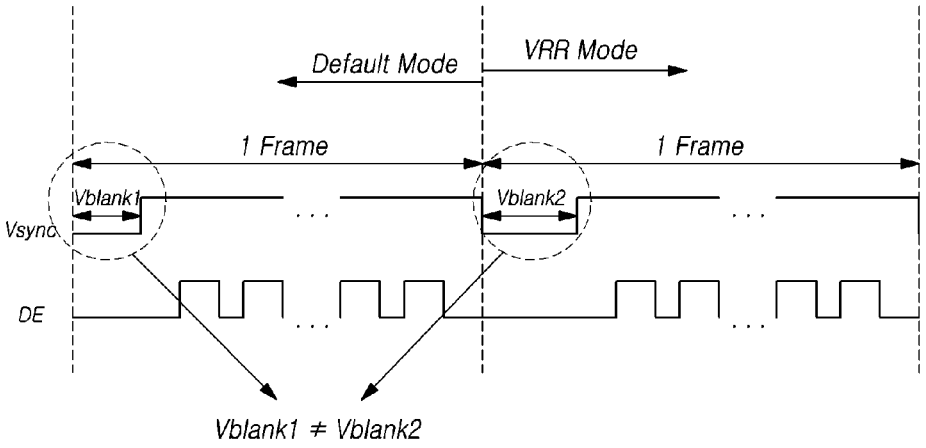
FIG. 7 illustrates an example of a signal waveform when a vertical blank period of a vertical synchronization signal is changed according to a mode change in a display device according to embodiments of the present disclosure.

FIG. 7 illustrates an example of a signal waveform when a vertical blank period of a vertical synchronization signal is changed according to a mode change in a display device according to embodiments of the present disclosure.

Referring to FIG. 7, the display device 100 according to embodiments of the present disclosure can operate at the default mode with one fixed frequency and the variable refresh rate mode (VRR Mode) with a plurality of frequencies according to the type of image data DATA supplied from the host system 200.

In this case, the default mode can be a first mode that displays general image data such as TV images with one fixed driving frequency, and the variable refresh rate mode can be a second mode that varies a plurality of driving frequencies for special image data such as game images or movies according to a selected function.

Therefore, the driving frequency for displaying the image data DATA is fixed to one in the default mode, but the driving frequency for displaying the image data DATA can be changed, for example, between a first frequency to the third frequency, according to a selected function during operation in the variable refresh rate mode.

When the display device 100 is changed from the default mode to the variable refresh rate mode by changing the image data DATA supplied from the host system 200 to the display device 100, the default frequency in the default mode can be different from the driving frequency in variable refresh rate mode.

At this time, when the driving frequency is changed during the variable refresh rate mode, one horizontal period 1H can be fixed to the same value, and the length of one frame can be adjusted by varying the vertical blank period Vblank.

Accordingly, when the driving frequency in the default mode is different from the driving frequency in the variable refresh rate mode, the vertical blank period Vblank1 of the vertical synchronization signal Vsync supplied from the host system 200 to the display device 100 in the default mode can be different from the vertical blank period Vblank2 of the vertical synchronization signal Vsync supplied in the variable refresh rate mode.

Accordingly, the display device 100 of the present disclosure can determine the changed driving frequency by detecting the time interval of the vertical blank period Vblank2 at the time when the default mode is changed to the variable refresh rate mode. Also, it can reduce image quality decrease such as image distortion or flicker due to luminance deviation by controlling the luminance of the display panel 110 according to the changed driving frequency.

Meanwhile, it has illustrated a case of changing from the default mode to the variable refresh rate mode as an example in the above, but even when the driving frequency is changed in the variable refresh rate mode, the time interval of the vertical blank period Vblank can be changed according to the driving frequency. Accordingly, the same can be applied not only when the operation mode is changed, but also when the driving frequency is changed within one operation mode.

Figure 8:
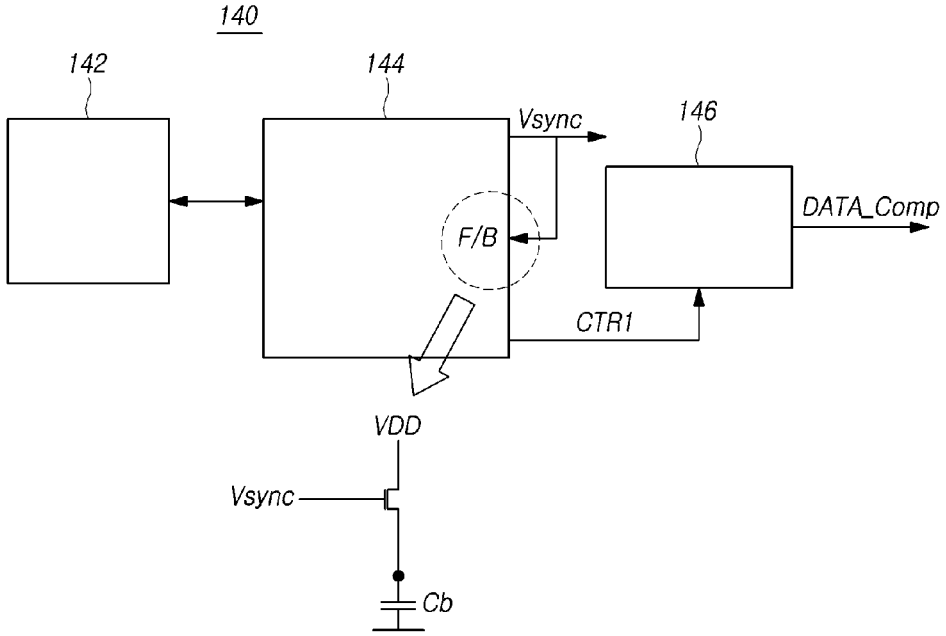
FIG. 8 illustrates an example of a system for compensating image data through variable information of a vertical synchronization signal in a display device according to embodiments of the present disclosure.

FIG. 8 illustrates an example of a system for compensating image data through variable information of a vertical synchronization signal in a display device according to embodiments of the present disclosure.

Referring to FIG. 8, the timing controller 140 in the display device 100 according to embodiments of the present disclosure can detect variable information of the image data DATA through a time interval of a vertical blank period Vblank of the vertical synchronization signal Vsync supplied from the host system 200, and compensate the image data DATA supplied to the display panel 110.

The timing controller 140 can include a control integrated circuit 142, a level shifter 144, and a compensating circuit 146.

The control integrated circuit 142 can control the operation of the timing controller 140.

The level shifter 144 can change the output level of the vertical synchronization signal Vsync supplied from the host system 200 according to the control of the control integrated circuit 142.

At this time, the level shifter 144 can include a feedback node F/B for detecting a time interval for the vertical blank period Vblank of the vertical synchronization signal Vsync. The feedback node F/B of the level shifter 144 can be connected to the gate node of the transistor disposed therein. A drain node of the transistor can be supplied with the power voltage VDD and a source node of the transistor can be connected to a charging capacitor Cb.

Accordingly, the vertical synchronization signal Vsync transmitted through the feedback node F/B charges the charging capacitor Cb connected to the transistor during the vertical blank period Vblank corresponding to the low level. Since the voltage charged in the charging capacitor Cb is charged to a voltage corresponding to the vertical blank period Vblank of the vertical synchronization signal Vsync, the driving frequency of the image data DATA supplied from the host system 200 can be determined by detecting the voltage charged in the charging capacitor Cb.

The control integrated circuit 142 determines the driving frequency of the image data DATA based on the voltage charged in the charging capacitor Cb of the level shifter 144, and controls the level shifter 144 to generate a control signal CTR1 and to supply the control signal CTR1 to the compensating circuit 146. Accordingly, the control signal CTR1 can be referred to as a signal for controlling the image data DATA supplied to the display panel 110 according to the driving frequency in the variable refresh rate mode.

The compensating circuit 146 can extract a compensating value from a lookup table in the memory MEM according to the control signal CTR1 transmitted through the level shifter 144, and generate a compensated image data DATA_Comp by adding or multiplying the compensating value to the image data DATA.

In addition, the display device 100 of the present disclosure can compensate for the luminance deviation caused by the change of the operating mode or the driving frequency by changing a display driving reference voltage VpreR transmitted through the reference voltage line RVL during the display driving period according to the vertical blank period Vblank of the vertical synchronization signal Vsync.

Figure 9:
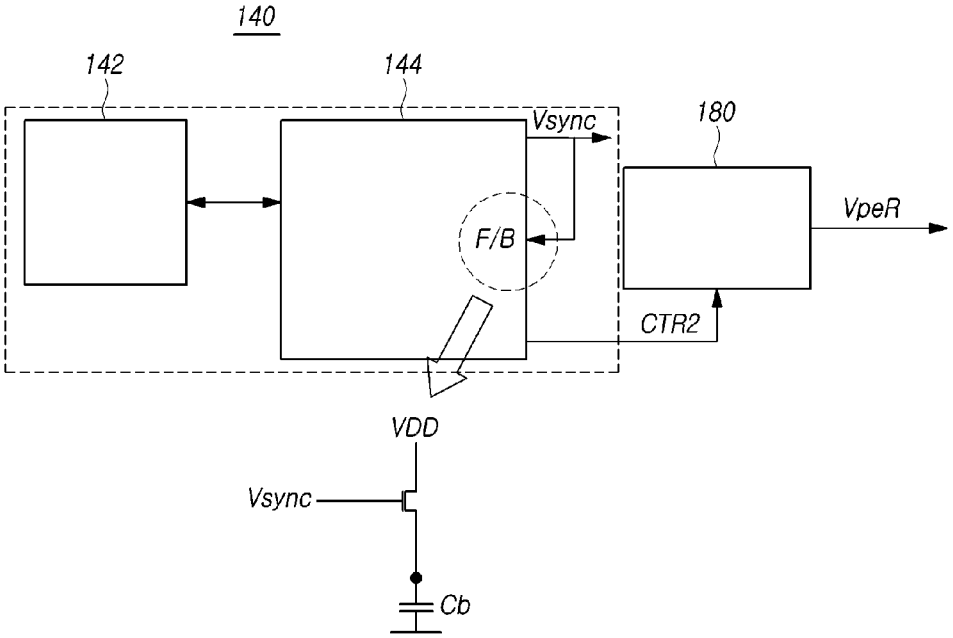
FIG. 9 illustrates an example of a system for compensating a display driving reference voltage through variable information of a vertical synchronization signal in the display device according to embodiments of the present disclosure.

FIG. 9 illustrates an example of a system for compensating a display driving reference voltage through variable information of a vertical synchronization signal in the display device according to embodiments of the present disclosure.

Referring to FIG. 9, the timing controller 140 in the display device 100 according to embodiments of the present disclosure can detect variable information of the image data DATA through a time interval of the vertical blank period Vblank of the vertical synchronization signal Vsync supplied from the host system 200, and reduce the luminance deviation by compensating the display driving reference voltage VpreR for initializing the subpixels SP during the display driving period.

The sensing reference voltage VpreS and the display driving reference voltage VpreR transmitted through the reference voltage line RVL are reference voltages for initializing the subpixels SP, and can be classified into a display driving reference voltage VpreR supplied during the display driving period and a sensing reference voltage VpreS supplied during a characteristic value sensing period.

For example, the sensing reference voltage VpreS is a reference voltage supplied to a source node N2 of the driving transistor DRT through the sensing transistor SENT during the sensing driving period for sensing the characteristic value of the driving transistor DRT.

In addition, the display driving reference voltage VpreR is supplied to a source node of the driving transistor DRT through the sensing transistor SENT during the display driving period to charge the source node of the driving transistor DRT with a voltage higher than 0V. In particular, the display driving reference voltage VpreR can provide a margin for setting a compensating value of the data voltage Vdata when the threshold voltage is shifted in the negative polarity direction due to bias stress at the gate node of the driving transistor DRT.

Accordingly, when the display device 100 is changed from the default mode to the variable refresh rate mode by the image data DATA supplied from the host system 200, the display device 100 of the present disclosure can reduce the luminance deviation which may be caused by the change of the driving frequency by controlling the display driving reference voltage VpreR to correspond to the driving frequency.

As described above, the level shifter 144 can change the output level of the vertical synchronization signal Vsync supplied from the host system 200 according to the control of the control integrated circuit 142.

In this case, the level shifter 144 can detect a time interval for the vertical blank period Vblank of the vertical synchronization signal Vsync through the feedback node F/B.

For example, the feedback node F/B of the level shifter 144 can be connected to the gate node of the transistor disposed therein. The drain node of the transistor can receive the power supply voltage VDD, and the source node of the transistor can be connected to the charging capacitor Cb.

Accordingly, the vertical synchronization signal Vsync transmitted through the feedback node F/B charges the charging capacitor Cb connected to the transistor during the vertical blank period Vblank corresponding to the low level. Since the voltage charged in the charging capacitor Cb is charged to a voltage corresponding to the vertical blank period Vblank of the vertical synchronization signal Vsync, the display device 100 of the present disclosure can determine the driving frequency of the image data DATA supplied from the host system 200 by detecting the voltage charged in the charging capacitor Cb.

Accordingly, the control integrated circuit 142 can determine the driving frequency of the image data DATA based on the voltage charged in the charging capacitor Cb, and can control the level shifter 144 to generate a control signal CTR2 and supply it to the reference voltage generating circuit 180 for controlling the display driving reference voltage VpreR according to the driving frequency of the image data DATA. Accordingly, the control signal CTR2 can be a signal for controlling the display driving reference voltage VpreR supplied to the reference voltage line RVL of the display panel 110 according to the driving frequency in the variable refresh rate mode.

The reference voltage generating circuit 180 is a part for generating voltages such as a display driving reference voltage VpreR and a sensing reference voltage VpreS, and can be configured as a separate circuit or can be configured in a programmable gamma circuit for controlling the maximum luminance value of the image data DATA.

Accordingly, the reference voltage generating circuit 180 can reduce the luminance deviation due to the change of the driving frequency by receiving the control signal CTR2 corresponding to the driving frequency of the image data DATA from the level shifter 144, and controlling the display driving reference voltage VpreR according to the control signal CTR2.

On the other hand, the display device 100 of the present disclosure can improve the image quality by detecting variable information through the data enable signal DE supplied from the host system 200 after the driving frequency is changed according to the operation mode and by compensating the expected luminance deviation.

Figure 10:
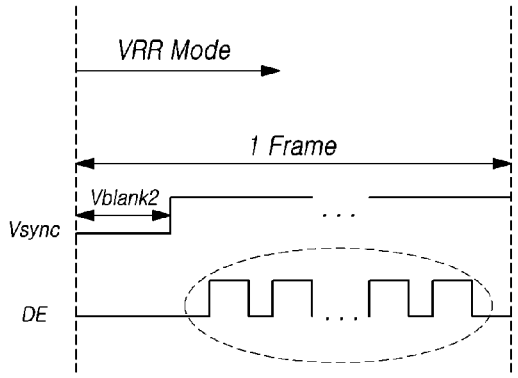
FIG. 10 illustrates an example of a signal waveform when the data enable signal is changed according to an operation mode in a display device according to embodiments of the present disclosure.

FIG. 10 illustrates an example of a signal waveform when the data enable signal is changed according to an operation mode in a display device according to embodiments of the present disclosure.

Referring to FIG. 10, the display device 100 according to embodiments of the present disclosure can have a default mode that operates at one fixed frequency and a variable refresh rate mode that operates a plurality of frequencies according to the type of image data DATA supplied from the host system 200.

In this case, the default mode can be a first mode that displays general image data such as TV images with one fixed driving frequency, and the variable refresh rate mode can be a second mode that varies a plurality of driving frequencies for special image data such as game images or movies according to a selected function.

Therefore, the driving frequency for displaying the image data DATA is fixed to one in the default mode, but the driving frequency for displaying the image data DATA can be changed, for example, between a first frequency to the third frequency, according to a selected function during operation in the variable refresh rate mode.

When the display device 100 is changed from the default mode to the variable refresh rate mode by changing the image data DATA supplied from the host system 200 to the display device 100, the default frequency in the default mode can be different from the driving frequency in variable refresh rate mode.

At this time, when the driving frequency is changed during the variable refresh rate mode, one horizontal period 1H can be fixed to the same value, and the length of one frame can be adjusted by varying the vertical blank period Vblank.

Accordingly, when the driving frequency in the default mode is different from the driving frequency in the variable refresh rate mode, the vertical blank period Vblank1 of the vertical synchronization signal Vsync supplied from the host system 200 to the display device 100 in the default mode can be different from the vertical blank period Vblank2 of the vertical synchronization signal Vsync supplied in the variable refresh rate mode.

At this time, since the data enable signal DE is transit during a period other than the vertical blank period Vblank of the vertical synchronization signal Vsync, the display device 100 of the present disclosure can calculate the driving frequency in the changed operation mode by counting a number of transition of the data enable signal DE during a period other than the vertical blank period Vblank.

Accordingly, the display device 100 of the present disclosure can determine the changed driving frequency by calculating a number of transitions of data enable signal DE within one frame passed from vertical blank period Vblank2 after the default mode is changed to the variable refresh rate mode. As a result, the display device 100 of the present disclosure can reduce image quality decrease such as image distortion or flicker due to a luminance deviation by controlling the luminance of the display panel 110 according to the changed driving frequency.

Here, a case of changing from the default mode to the variable refresh rate mode as an example has been discussed. However, even when the driving frequency is changed in the variable refresh rate mode, the number of transitions of the data enable signal DE can be changed according to the driving frequency. Accordingly, the driving method of the present disclosure can be applied not only when the operation mode is changed, but also when the driving frequency is changed within one operation mode.

Figure 11:
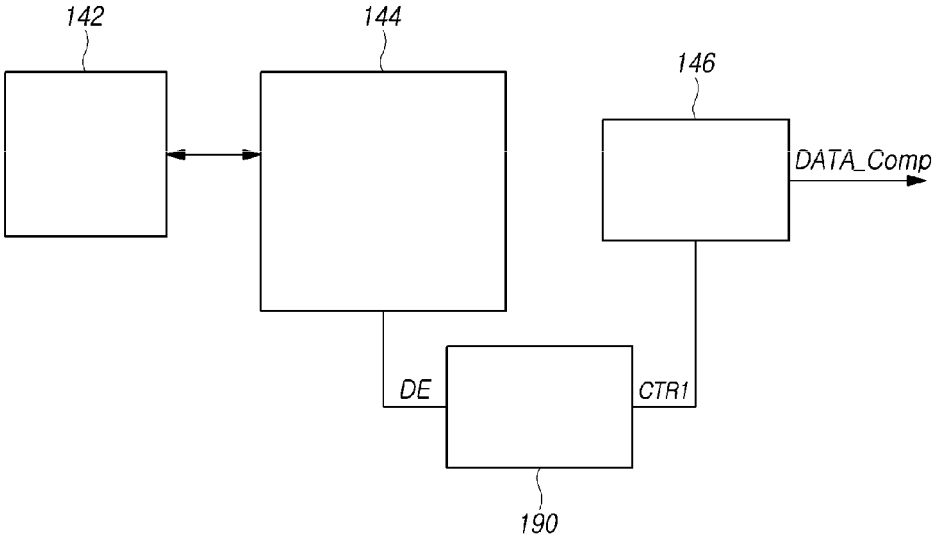
FIG. 11 illustrates an example of a system for compensating image data through variable information of a data enable signal in a display device according to embodiments of the present disclosure.

FIG. 11 illustrates an example of a system for compensating image data through variable information of a data enable signal in a display device according to embodiments of the present disclosure.

Referring to FIG. 11, the timing controller 140 in the display device 100 according to embodiments of the present disclosure can detect variable information of image data DATA from the data enable signal DE supplied from the host system 200 and compensate the image data DATA supplied to the display panel 110.

The timing controller 140 can include a control integrated circuit 142, a level shifter 144, and a compensating circuit 146. The control integrated circuit 142 can control the operation of the timing controller 140. The level shifter 144 can change the output level of the data enable signal DE supplied from the host system 200 under the control of the control integrated circuit 142.

A counter 190 receives the data enable signal DE transmitted through the level shifter 144 and counts the number of transitions within one frame. At this time, the counter 190 can calculate the changed driving frequency by counting the number of transitions of the data enable signal DE during a period other than the vertical blank period within one frame after the driving frequency is changed by the operation mode.

The compensating circuit 146 can receive a control signal CTR1 corresponding to the driving frequency of the image data DATA from the counter 190, extract a compensating value from the lookup table in the memory MEM according to the control signal CTR1, and generate the compensated image data DATA_Comp by adding or multiplying the compensating value to the image data DATA.

In addition, the display device 100 of the present disclosure can compensate for the luminance deviation which may be caused by the change of the operation mode or the driving frequency, by changing the display driving reference voltage VpreR transmitted through the reference voltage line RVL during the display driving period according to a number of transitions of the data enable signal DE.

Figure 12:
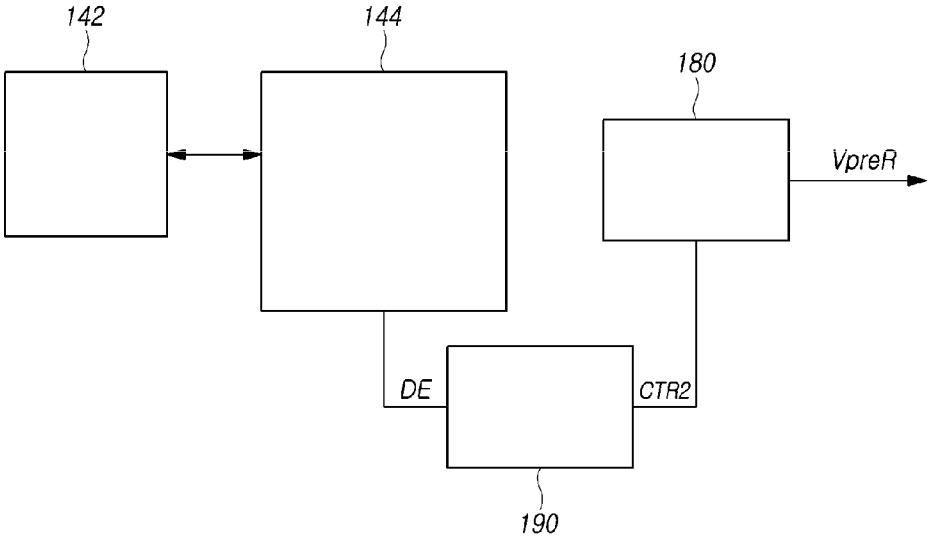
FIG. 12 illustrates an example of a system in the case of compensating a display driving reference voltage using variable information of a data enable signal in the display device according to embodiments of the present disclosure.

FIG. 12 illustrates an example of a system in the case of compensating a display driving reference voltage using variable information of a data enable signal in the display device according to embodiments of the present disclosure.

Referring to FIG. 12, the timing controller 140 in the display device 100 according to embodiments of the present disclosure can reduce the luminance deviation by calculating the driving frequency of the image data DATA based on the number of transitions of the data enable signal DE transmitted from the host system 200 and compensating the display driving reference voltage VpreR for initializing the subpixels SP during the display driving period.

The sensing reference voltage VpreS and the display driving reference voltage VpreR transmitted through the reference voltage line RVL are reference voltages for initializing the subpixels SP, and can be classified into a display driving reference voltage VpreR supplied during the display driving period and a sensing reference voltage VpreS supplied during a characteristic value sensing period.

Accordingly, the display device 100 of the present disclosure can reduce the luminance deviation caused by the change of the driving frequency by controlling the display driving reference voltage VpreR to correspond to the driving frequency when the display device 100 is changed from the default mode to the variable refresh rate mode according to the image data DATA supplied from the host system 200.

As described above, the level shifter 144 in the timing controller 140 can change the output level of the data enable signal DE supplied from the host system 200 under the control of the control integrated circuit 142.

The counter 190 receives the data enable signal DE transmitted through the level shifter 144 and counts the number of transitions within one frame. At this time, the counter 190 can calculate the changed driving frequency by counting the number of transitions of the data enable signal DE during a period other than the vertical blank period within one frame after the driving frequency is changed by the operation mode.

Accordingly, the counter 190 generates a control signal CTR2 corresponding to the driving frequency of the image data DATA and supplies it to the reference voltage generating circuit 180 for controlling the display driving reference voltage VpreR.

The reference voltage generating circuit 180 is a part for generating voltages such as a display driving reference voltage VpreR and a sensing reference voltage VpreS, and can be configured as a separate circuit or configured in a programmable gamma circuit for controlling the maximum luminance value of the image data DATA.

Accordingly, the reference voltage generating circuit 180 can reduce the luminance deviation due to the change of the driving frequency by receiving the control signal CTR2 corresponding to the driving frequency of the image data DATA from the counter 190, and controlling the display driving reference voltage VpreR according to the control signal CTR2.

The above description and the accompanying drawings provide an example of the technical idea of the present disclosure for illustrative purposes only. Those having ordinary knowledge in the technical field, to which the present disclosure pertains, will appreciate that various modifications and changes in form, such as combination, separation, substitution, and change of a configuration, are possible without departing from the essential features of the present disclosure.

Therefore, the embodiments disclosed in the present disclosure are intended to illustrate the scope of the technical idea of the present disclosure, and the scope of the present disclosure is not limited by the embodiment. The scope of the present disclosure shall be construed on the basis of the accompanying claims in such a manner that all of the technical ideas included within the scope equivalent to the claims belong to the present disclosure.

What is claimed is:

1. A display device comprising:

a display panel including a plurality of gate lines, a plurality of data lines, and a plurality, of subpixels;

a gate driving circuit configured to supply scan signals to the plurality of gate lines;

a data driving circuit configured to supply data voltages to the plurality of data lines; and a timing controller configured to control the gate driving circuit and the data driving circuit, and control a luminance of the plurality of subpixels according to a driving frequency of image data by detecting variable information which is changed according to the driving frequency of the image data supplied from a host system, wherein the variable information is calculated throe h a time interval of a vertical blank period of a vertical synchronization signal supplied from the host system.

2. The display device according to claim 1, wherein the timing controller includes:

a default mode for displaying the image data at one driving frequency; and a variable refresh rate mode for displaying the image data at a plurality of frequencies.

3. The display device according to claim 2, wherein in the variable refresh rate mode; the image data with a predetermined luminance is supplied to the display panel for a predetermined period.

4. The display device according to claim 2, wherein in the variable refresh rate mode; one horizontal period is the same and a vertical blank period is variable with respect to the plurality of driving frequencies.

5. The display device according to claim 1, wherein the timing controller includes:

a level shifter configured to control an output level of the vertical synchronization signal, and generate a control signal according to the vertical blank period of the vertical synchronization signal; and a control integrated circuit configured to control an operation of the level shifter.

6. The display device according to claim 5, wherein the level shifter includes a transistor to which the vertical synchronization signal is supplied to a gate node; a power voltage is connected to a drain node, and a charging capacitor is connected to a source node.

7. The display device according to claim 5, wherein the control signal is a signal for controlling a compensating circuit configured to generate a compensating value for the data voltage according to a characteristic value sensed from the plurality of subpixels.

8. The display device according to claim 5, wherein the control signal is a signal for controlling a reference voltage generating circuit configured to generate a display driving reference voltage supplied to the plurality of subpixels through a reference voltage line during a display driving period.

9. A display device comprising:

a display panel including a plurality of gate lines, a plurality of data lines, and a plurality, of subpixels;

a gate driving circuit configured to supply scan signals to the plurality of gate lines;

a data driving circuit configured to supply data voltages to the plurality of data lines; and a timing controller configured to control the Gate driving circuit and the data driving circuit, and control a luminance of the plurality of subpixels according to a driving frequency of image data by detecting variable information which is changed according to the driving frequency of the image data supplied from a host system, wherein the variable information is calculated by a number of transitions of a data enable signal supplied from the host system.

10. The display device according to claim 9; wherein the timing controller includes:

a default mode for displaying the image data at one driving frequency; and a variable refresh rate mode for displaying the image data at a plurality of frequencies.

11. The display device according to claim 9, wherein the timing controller includes:

a level shifter configured to control an output level of the data enable signal;

a control integrated circuit configured to control an operation of the level shifter; and a counter configured to generate a control signal by counting the number of transitions of the data enable signal supplied from the level shifter.

12. The display device according to claim 11, wherein the control signal is a signal for controlling a compensating circuit configured to generate a compensating value for the data voltage according to a characteristic value sensed from the plurality of subpixels.

13. The display device according to claim 11, wherein the control signal is a signal for controlling a reference voltage generating circuit configured to generate a display driving reference voltage supplied to the plurality of subpixels through a reference voltage line during a display driving period.

14. A driving method for a display device, the display device including a display panel having a plurality of gate lines, a plurality of data lines, and a plurality of subpixels; a gate driving circuit configured to supply scan signals to the plurality of gate lines; a data driving circuit configured to supply data voltages to the plurality of data lines; and a timing controller, the driving method comprising:

receiving image data and at least one timing signal corresponding to a driving frequency of the image data from a host system;

detecting variable information which is changed according to the driving frequency of the image data from the at least one timing signal; and controlling, by the timing controller, a luminance of the plurality of subpixels according to the driving frequency of the image data based on the variable information, wherein the variable information is either calculated through a time interval of a vertical blank period of a vertical synchronization signal supplied from the host system, or calculated by a number of transitions of a data enable signal supplied from the host system.

15. The driving method according to claim 14, wherein the controlling the luminance of the plurality of subpixels comprises:

controlling a compensating value for the data voltage according to a characteristic value sensed by the plurality of subpixels; or controlling a display driving reference voltage supplied to the plurality of subpixels through a reference voltage line during a display driving period.

16. The driving method according to claim 14, wherein the controlling the luminance of the plurality of subpixel s comprises:

controlling a compensating value for the data voltage according to a characteristic value sensed by the plurality of subpixels.

17. The driving method according to claim 14, wherein the controlling the luminance of the plurality of subpixels comprises:

controlling a display driving reference voltage supplied to the plurality of subpixels through a reference voltage line during a display driving period.

18. The driving method according to claim 14, wherein in the receiving step, the image data is received to display the image data in one of the following modes:

a default mode for displaying the image data at one driving frequency; and a variable refresh rate mode for displaying the image data at a plurality of frequencies.

19. The driving method according to claim 18, wherein in the variable refresh rate mode, the image data with a predetermined luminance is supplied to the display panel for a predetermined period.

* * * * *